United States Patent [19]

Uozumi et al.

[11] Patent Number: 4,932,386

[45] Date of Patent: Jun. 12, 1990

[54] FUEL-VAPOR PURGE AND AIR-FUEL RATIO CONTROL FOR AUTOMOTIVE ENGINE

[75] Inventors: Yasuji Uozumi; Shinichi Kitajima, both of Saitama, Japan

[73] Assignee: Honda Giken Kogyo Kabushiki Kaisha, Tokyo, Japan

[21] Appl. No.: 891,265

[22] Filed: Jul. 28, 1986

[30] Foreign Application Priority Data

| | | | |
|---|---|---|---|
| Jul. 26, 1985 | [JP] | Japan | 60-165312 |
| Jul. 26, 1985 | [JP] | Japan | 60-165313 |
| Aug. 20, 1985 | [JP] | Japan | 60-182743 |

[51] Int. Cl.[5] ..... F02M 39/00

[52] U.S. Cl. ..... 123/520; 123/521

[58] Field of Search ..... 123/518, 519, 520, 521

[56] References Cited

U.S. PATENT DOCUMENTS

| | | | |
|---|---|---|---|
| 4,326,489 | 4/1982 | Heitert | 123/519 |
| 4,377,142 | 3/1983 | Otsuka | 123/520 |
| 4,467,769 | 8/1984 | Matsumura | 123/520 |
| 4,630,581 | 12/1986 | Shibata | 123/520 |
| 4,641,623 | 2/1987 | Hamburg | 123/520 |
| 4,651,889 | 3/1987 | Uranishi | 123/519 |

FOREIGN PATENT DOCUMENTS

| | | | |
|---|---|---|---|
| 52-18534 | 8/1975 | Japan | 123/520 |
| 57-52663 | 3/1982 | Japan | 123/520 |
| 0091357 | 5/1983 | Japan | 123/520 |
| 58-191361 | 11/1983 | Japan | 123/520 |
| 0039957 | 3/1984 | Japan | 123/520 |
| 0001857 | 1/1986 | Japan | 123/520 |

*Primary Examiner*—Carl Stuart Miller

*Attorney, Agent, or Firm*—Lyon & Lyon

[57] ABSTRACT

A fuel-vapor purge and air-fuel ratio control system controls the amount of fuel vapor to be purged under an engine vacuum into a carburetor of an automotive engine from a charcoal canister and also controls the air-fuel ratio of an air-fuel mixture to be supplied to the carburetor. The fuel vapor is purged form the charcoal canister by applying the engine vacuum to the charcoal canister only when the air-fuel ratio is controlled. The applied engine vacuum may be regulated to control the amount of purged fuel vapor to change in proportion to the amount of air drawn by the engine, or the amount of purged fuel vapor may be increased to an upper limit when the air-fuel ratio is in a normal air-fuel ratio control region, and the amount of purged fuel vapor may be reduced to a lower limit when the air-fuel ratio is outside the normal air-fuel ratio control region. Alternatively, the controlling of the air-fuel ratio may forcibly be brought to a central value of an air-fuel ratio control range when purged fuel vapor is cut off of the amount of purged fuel vapor is abruptly reduced.

6 Claims, 5 Drawing Sheets

FUEL-VAPOR PURGE AND AIR-FUEL RATIO CONTROL FOR AUTOMOTIVE ENGINE

BACKGROUND OF THE INVENTION

The present invention relates to a system for controlling the amount of fuel vapor to be purged into a carburetor from a charcoal canister of a fuel-vapor recovery system and also for controlling the air-fuel ratio of an air-fuel mixture to be supplied by the carburetor for internal combustion engines on automobiles.

There is known a fuel-vapor recovery system associated with an automotive engine for temporarily storing fuel vapor from a fuel tank and a carburetor float bowl into a charcoal canister when the engine is shut off and for purging the stored fuel vapor into the carburetor when the engine is in operation. The fuel vapor stored in the charcoal canister is purged therefrom under vacuum developed in the intake manifold when the engine is started. The fuel-vapor recovery system thus serves to prevent fuel vapor from being lost from the fuel tank at an atmospheric temperature while the automobile is being parked and also from the carburetor float bowl at an elevated engine temperature when the engine is stopped. Normally the amount of fuel vapor produced at an atmospheric or elevated temperature is relatively small, and therefore full fuel-vapor flow from the canister does not substantially affect engine operation even if it is not controlled according to engine operating conditions.

However, one recent fuel-vapor recovery system also includes an on-board charcoal canister of a large fuel-vapor storage capacity added for storing a much greater amount of fuel vapor developed in the fuel tank when fuel is supplied under high pressure to the fuel tank from a fuel supply nozzle at a gasoline station. The amount of fuel vapor stored in, and hence purged from, the on-board charcoal canister is quite large, and, unless properly controlled, would upset the air-fuel ratio of the air-fuel mixture supplied to the engine, thereby adversely affecting the emission reduction capability of the engine and the exhaust gas discharged from the engine. Where the engine is equipped with an air-fuel ratio control system for optimizing the air-fuel ratio of the air-fuel mixture based on a detected density of oxygen contained in the exhaust gas, an air-fuel ratio disturbed by the purged fuel vapor flow would be apt to prevent the air-fuel ratio control system from properly controlling the air-fuel ratio.

To minimize the adverse effects on the engine while allowing a sufficient fuel-vapor flow from the on-board canister to the carburetor, it is necessary, in combination with an air-fuel ratio control system, to control the purged amount of fuel vapor from the on-board canister in proportion to the amount of air drawn by the engine. If the fuel vapor were not controlled in proportion to the amount of drawn air, then the control of the air-fuel ratio by the air-fuel ratio control system would not be performed correctly. Furthermore, if the purged fuel vapor were to be varied in quick response to the start of an air-fuel ratio control mode or changes in the amount of air drawn by the engine, then the actual air-fuel ratio would deviate widely from an air-fuel ratio setpoint due to a response delay caused by the closed feedback loop of the air-fuel ratio control system, and hence it would take a long period of time before the actual air-fuel ratio would settle into the air-fuel ratio setpoint.

As disclosed in Japanese Laid-Open Publication No. 57(1983)-20529, the air-fuel ratio control system typically includes an $O_2$ sensor for detecting a density of oxygen in the exhaust gas discharged from the engine and an electronic control unit (ECU) responsive to a signal from the $O_2$ sensor for operating an actuator to control the density of an air-fuel mixture in the carburetor so that the air-fuel ratio of the air-fuel mixture will be equalized to a stoichiometric air-fuel ratio. Specifically, the actuator controls the air-fuel mixture density by varying the cross-sectional area of a passage for introducing air therethrough into in the carburetor or of a passage for supplying fuel therethrough into the carburetor. The information derived from the output signal generated by the $O_2$ sensor is indicative of only whether the air-fuel mixture is richer or leaner than the stoichiometric air-fuel ratio, but not of how wide the actual air-fuel ratio deviates from the stoichiometric air-fuel ratio. Therefore, the ECU operates to vary the air-fuel ratio to a predicted extent in the PI control mode in the direction that is determined by the binary output signal from the $O_2$ sensor. In addition, various engine operating conditions are detected by an engine condition detector for enabling the ECU to control the air-fuel ratio at a level optimum for the engine operation.

The time required for the $O_2$ sensor to respond to the oxygen density, the time required for the ECU to effect given calculations, and the time required for the actuator to operate, result in the response delay, as described above, of the closed feedback loop of the air-fuel ratio control system.

SUMMARY OF THE INVENTION

It is an object of the present invention to provide a fuel-vapor purge and air-fuel ratio control system for use with automotive engines, which purges stored fuel vapor from a charcoal canister of a fuel-vapor recovery system into a carburetor in proportion to the amount of air fed to the engine under air-fuel ratio control.

Another object of the present invention is to provide a fuel-vapor purge and air-fuel ratio control system for use with automotive engines, which purges stored fuel vapor from a charcoal canister according to the response delay of an air-fuel ratio control loop.

Still another object of the present invention is to provide a fuel-vapor purge and air-fuel ratio control system for use with automotive engines, which purges stored fuel vapor from a charcoal canister in a quantity greater than that which is proportional to the amount of air fed to the engine under normal air-fuel ratio control.

A still further object of the present invention is to provide a fuel-vapor purge and air-fuel ratio control system for use with automotive engines, which operates to shorten a response delay of an air-fuel ratio control loop when the amount of fuel vapor purged from a charcoal canister into a carburetor is abruptly changed.

According to the present invention, there is provided a system for controlling the amount of fuel vapor to be purged under an engine vacuum into a carburetor of an automotive engine from a charcoal canister and for controlling the air-fuel ratio of an air-fuel mixture to be supplied to the carburetor. The system includes first means for controlling the air-fuel ratio, and second means for applying the engine vacuum to the charcoal canister to cause fuel vapor to be purged therefrom only when the air-fuel ratio is controlled by the first means. The system may also include third means for regulating the applied engine vacuum to control the amount of purged fuel vapor to change in proportion to the amount of air drawn by the engine, or for regulating the engine vacuum to establish upper and lower limits for the amount of purged fuel vapor, and for increasing the amount of purged fuel vapor to the upper limit when the air-fuel ratio is in a normal air-fuel ratio control region in which the air-fuel ratio deviates relatively slightly from an air-fuel ratio setpoint and for reducing the amount of purged fuel vapor to the lower limit when the air-fuel ratio is outside the normal air-fuel ratio control region. Alternatively, the first means may include means for forcibly bringing the controlling of the air-fuel ratio to a central value of an air-fuel ratio control range when purged fuel vapor is cut off or the amount of purged fuel vapor is abruptly reduced.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
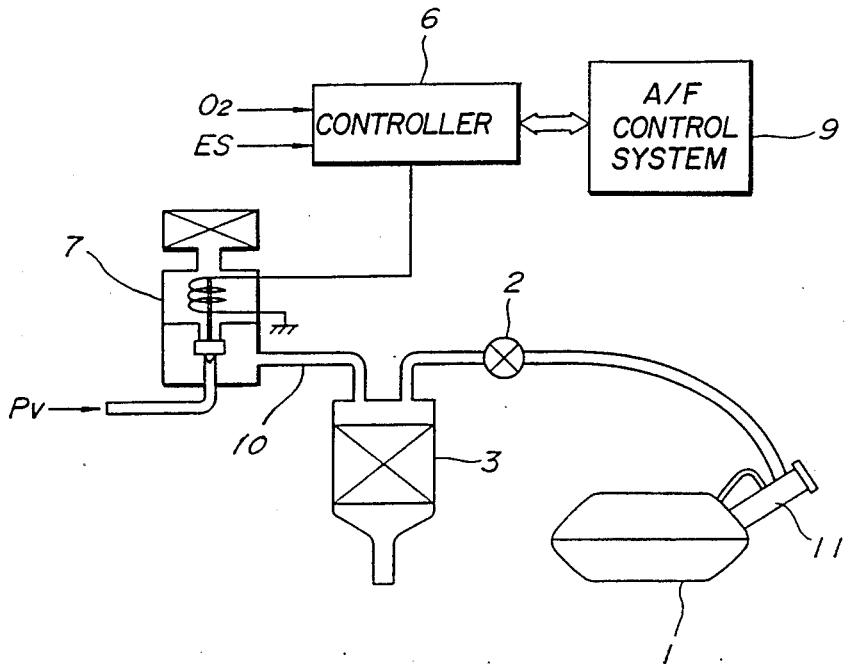
FIG. 1 is a schematic view of a fuel-vapor purge and air-fuel ratio control system according to the present invention.

FIG. 1 shows a fuel-vapor purge and air-fuel ratio control system according to the present invention.

An on-board charcoal canister 3 for storing fuel vapor is connected through a two-way valve 2 to a fuel filler pipe 11 of a fuel tank 1 mounted on an automobile. The charcoal canister 3 is coupled through a purge line 10 to a purge-control solenoid-operated valve 7. The solenoid-operated valve 7 is controlled by a controller 6 in the form of an electronic control unit (ECU) for introducing, shutting off, or regulating a venturi vacuum PV from a carburetor thereby to purge, shut off, or regulate fuel vapor from the charcoal canister 3.

The controller 6 is associated with and serves as a controller for an air-fuel ratio control system or loop 9 (FIG. 2) for the engine of the automobile. More specifically, the air-fuel ratio control system or loop 9 typically comprises an $O_2$ sensor 20 for detecting the density of oxygen contained in the exhaust gas discharged from an engine 21, an actuator 22 for controlling the amount of fuel or air supplied to a carburetor 23, and the controller 6 responsive to an output signal from the $O_2$ sensor 20 for controlling the actuator 22. The air-fuel ratio control system 9 also includes an engine condition detector 24 for detecting various engine conditions such as the temperature of the coolant for the engine, the speed of rotation of the engine, the absolute pressure in the intake manifold, and the atmospheric pressure. Therefore, the controller 6 controls the air-fuel ratio for the engine in response to an output signal $O_2$ from the $O_2$ sensor 20 and also in response to output signals ES from the engine condition detector 24.

Figure 3:
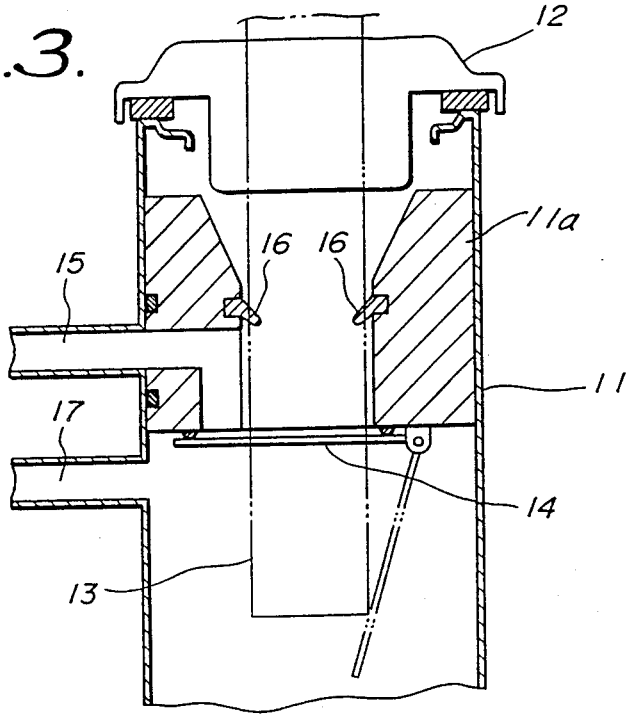
FIG. 3 is an enlarged fragmentary cross-sectional view of the inlet nozzle of a fuel tank shown in FIG. 1.

FIG. 3 shows the fuel filler pipe 11 in greater detail. The fuel filler pipe 11 is normally covered with a filler cap 12 and has an annular nozzle member 11*a* with an annular nozzle seal 16 mounted therein. A shutter 14 is swingably mounted on the annular nozzle member 11*a* for normally closing the filler passage in the fuel filler pipe 11. The filler pipe 11 is connected by a fuel tank vent 15 to the charcoal canister 3, and is also connected to a breather pipe 17. When the filler cap is removed and a fuel supply nozzle 13 is inserted into the filler pipe 11 through the annular nozzle member 11*a*, the shutter 14 is swung downwardly by the tip of the fuel supply nozzle 13. As fuel is supplied from the fuel supply nozzle 13 into the fuel tank 1, a large amount of fuel vapor is produced and delivered through the fuel tank vent 15 to the charcoal canister 3. At this time, the fuel vapor is prevented by the nozzle seal 16 from leaking out of the inlet end of the filler pipe 11. Except when the fuel supply nozzle 13 is inserted into the filler pipe 11, the shutter 14 closes the filler passage to prevent fuel vapor from entering the fuel tank vent 15.

In operation, the purge control solenoid-operated valve 7 is opened by the controller 6 to allow fuel vapor stored in the charcoal canister 3 to be purged during a period T2 (FIG. 4) in which the air-fuel ratio is controlled. At the same time, the solenoid-operated valve 7 is also controlled by the controller 6 to adjust the opening thereof for purging fuel vapor at a rate proportional to the amount of air which is drawn into the engine according to the air-fuel ratio control.

More specifically, during periods T1, T3 in which no air-fuel ratio control is effected, the controller 6 applies a command to the solenoid-operated valve 7 to close same completely. The venturi vacuum PV is therefore shut off by the solenoid-operated valve 7, thereby preventing fuel vapor from being purged from the charcoal canister 3 to a venturi nozzle in the the carburetor. During the air-fuel ratio control period T2, the controller 6 applies an opening command to the solenoid-operated valve 7 to open and control same to provide a valve opening in proportion to the amount Qa of air drawn by the engine, for thereby regulating the amount Qp of fuel vapor purged from the charcoal canister 3. When the amount Qa of drawn air is of a certain constant level L immediately after the air-fuel ratio control is started and immediately before the air-fuel ratio control is finished, the controller 6 applies a first opening command to the solenoid-operated valve 7 to open same to a predetermined miminim opening for purging fuel vapor from the charcoal canister 3. At this time, the amount Qp of purged fuel vapor is minimum.

With fuel vapor thus purged from the charcoal canister 3 during the air-fuel ratio control period under the control of the controller 6, the air-fuel ratio is not disturbed largely. Since the amount Qp of purged fuel vapor is regulated according to the air-fuel ratio control, fuel vapor stored in the charcoal canister 3 can be purged into the carburetor in a quantity proportional to the amount Qa of air drawn by the engine.

Figure 2:
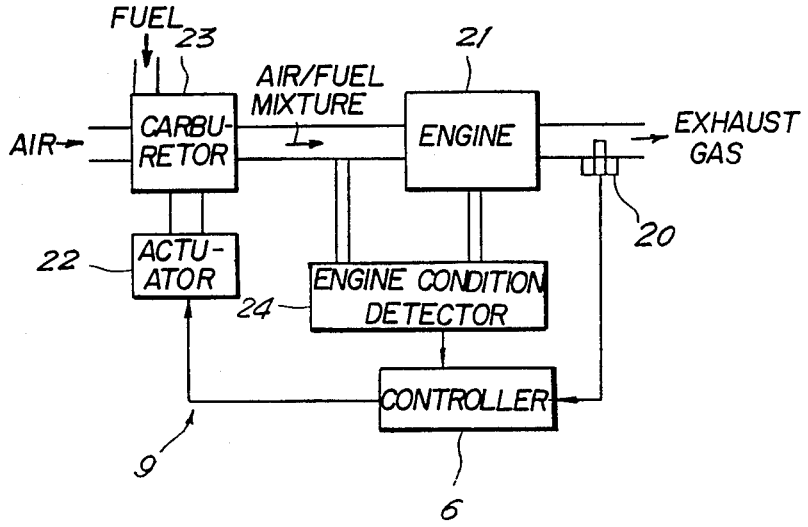
FIG. 2 is a block diagram of a typical air-fuel ratio control loop.
Figure 4:
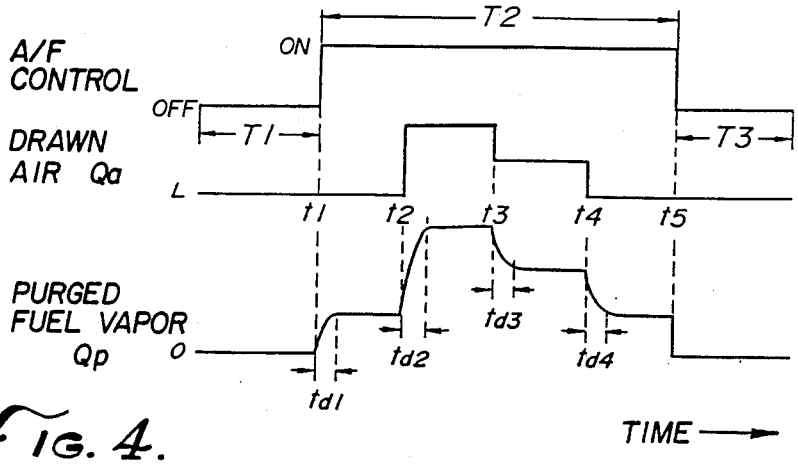
FIG. 4 is a timing chart of operation of a controller shown in FIG. 1.

The closed air-fuel ratio control loop 9 as shown in FIG. 2 has an inherent response delay due to the time required for the $O_2$ sensor 20 to respond to the oxygen density in the exhaust gas, the time required for the controller 6 to effect given calculations, and the time required for the actuator 22 to operate for regulating the amount of air or fuel. When the controller 6 applies the first opening command to the solenoid-operated valve 7 at a time t1 to start an air-fuel ratio control mode as shown in FIG. 4, the controller 6 opens the solenoid-operated valve 7 gradually with a time constant commensurate with the response delay of the closed air-fuel ratio control loop 9, so that the solenoid-operated valve 7 will be opened to a required extent after a time interval td1. Likewise, when the controller 6 adjusts the opening of the solenoid-operated valve 7 according to the amount Qa of drawn air, the controller 6 controls the solenoid-operated valve 7 to open or close same gradually with a time constant, so that it will be opened to a required extent after a time interval td2 or closed to required extents after respective time intervals td3, td4. When the air-fuel ratio control mode is finished at a time t5, the response delay of the air-fuel ratio control loop 9 causes no problem, and hence the controller 7 fully closes the solenoid-operated valve 7 immediately at the time t5 with no time constant involved.

By thus adjusting the opening of the solenoid-operated valve 7 with a time constant under the control of the controller 6, any actual air-fuel ratio controlled by the air-fuel ratio control loop 9 is prevented from deviating widely from an air-fuel ratio setpoint regardless of the response delay of the air-fuel ratio control loop 9.

Figure 5A:
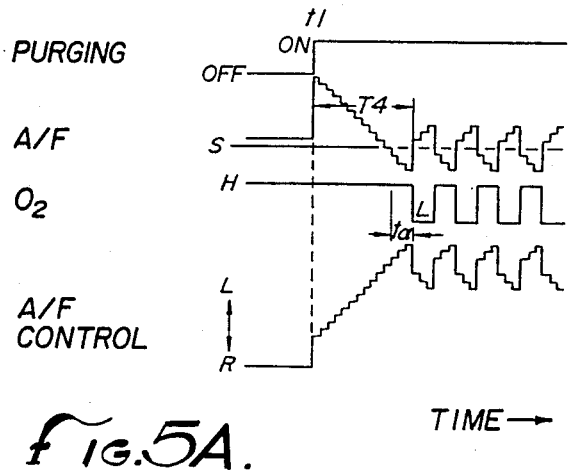
FIG. 5A is a timing chart showing a conventional mode of purging fuel vapor from a canister under air-fuel ratio control.

This fuel-vapor purging control mode will be described in greater detail with reference to FIGS. 5A and 5B. The response delay of the air-fuel ratio control loop 9 is denoted at $t\alpha$ in FIGS. 5A and 5B. FIG. 5A shows a conventional control mode of purging fuel vapor. If fuel vapor is purged abruptly to a full extent at the time t1 for starting air-fuel ratio control, then the air-fuel ratio control cannot immediately follow the purged fuel vapor, and the actual air-fuel ratio tends to deviate widely from an air-fuel ratio setpoint S during an early time interval following the time t1. Therefore, it will take a relatively long period of time T4 before the actual air-fuel ratio A/F settle into the setpoint S through the air-fuel ratio control (indicated by A/F CONTROL in FIG. 5A) based on the output signal $O_2$ (indicated by $O_2$ in FIG. 5A) from the $O_2$ sensor. During the time period T4, the air-fuel ratio is inappropriate for the engine, and hence adversely affects the emission reduction capability of the engine and the exhaust gas discharged from the engine.

Figure 5B:
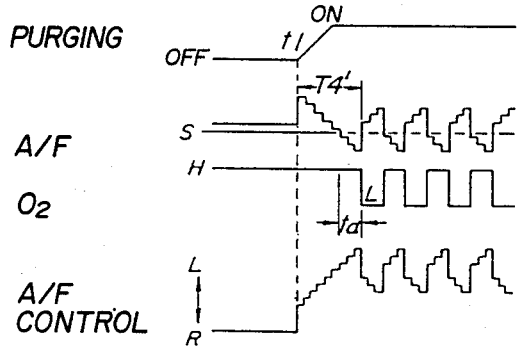
FIG. 5B is a timing chart showing a mode, according to an embodiment of the present invention, of purging fuel vapor from a canister under air-fuel ratio control.

If, on the other hand, fuel vapor is purged gradually at an increasing rate from the time t1 with a certain time constant, as shown in FIG. 5B, then the air-fuel ratio control can follow the purged fuel vapor, and the actual air-fuel ratio does not deviate widely from an air-fuel ratio setpoint S during an early time interval following the time t1. Therefore, it will take a shorter period of time T4' before the actual air-fuel ratio A/F settles into the setpoint S through the air-fuel ratio control based on the output signal $O_2$ from the $O_2$ sensor. Accordingly, during the time period T4', the air-fuel ratio remains relatively appropriate for the engine, and hence does not adversely affect the emission reduction capability of the engine and the exhaust gas discharged from the engine.

Figure 6:
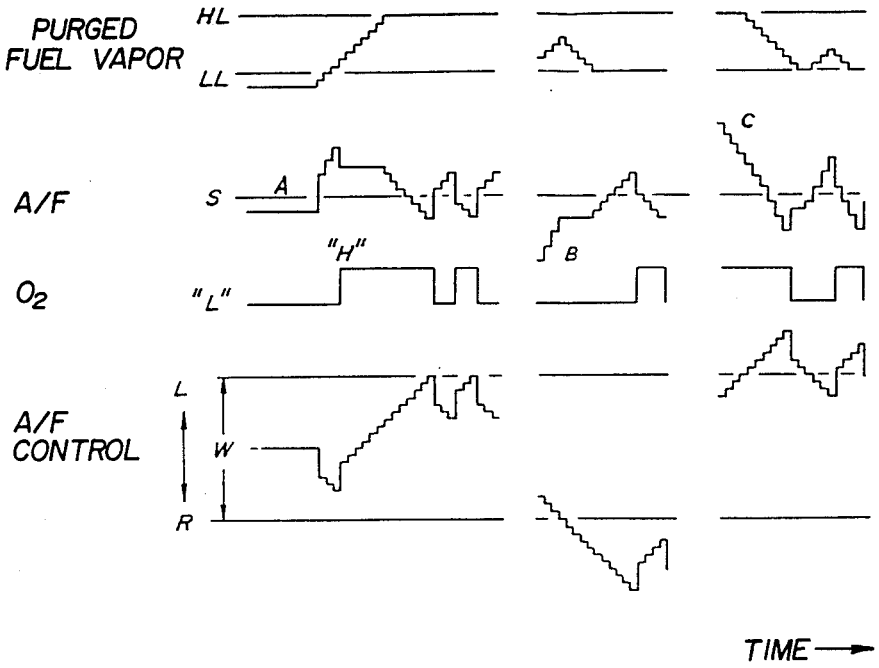
FIG. 6 is a timing chart showing a mode, according to another embodiment of the present invention, of purging fuel vapor from a canister under air-fuel ratio control.

FIG. 6 shows a fuel-vapor purge control mode according to another embodiment of the present invention. In this control mode, while the air-fuel ratio control is not effected by the controller 6, the controller 6 fully closes the solenoid-operated valve 7 to purge no fuel vapor from the charcoal canister 3. During an air-fuel ratio control period, the controller 6 opens the solenoid-operated valve 7 to allow fuel vapor to be controllably purged from the charcoal canister 3. More specifically, for effecting such fuel vapor purge control, the controller 6 establishes an upper limit HL and a lower limit LL for the purged amount of fuel vapor according to the engine load condition. For example, for a high engine load, the upper purge limit HL is selected to be 80% of the amount of fuel vapor that is purged when the solenoid-operated valve 7 is fully opened, and the lower purge limit LL is selected to be 20% of the amount of fuel vapor that is purged when the solenoid-operated valve 7 is fully opened. For a low engine load, the upper purge limit HL is selected to be 40% of the amount of fuel vapor that is purged when the solenoid-operated valve 7 is fully opened, and the lower purge limit LL is selected to be 20% of the amount of fuel vapor that is purged when the solenoid-operated valve 7 is fully opened.

Then, the controller 6 adjusts the opening of the solenoid-operated valve 7 according to the air-fuel ratio control to purge fuel vapor in a regulated quantity between the upper and lower limits HL, LL. In this control mode, the controller 6 increases the purged fuel vapor up to the upper limit HL in a normal control region A (FIG. 6) in which the actual air-fuel ratio A/F deviates slighly from the air-fuel ratio setpoint S, and the controller 6 reduces the purged fuel vapor down to the lower limit LL in regions B, C, other than the normal control region A, in which the actual air-fuel ratio A/F deviates largely from the air-fuel ratio setpoint S. In FIG. 6, the actual air-fuel ratio A/F is largely lower than the setpoint S in the region B, and the actual air-fuel ratio A/F is largely higher than the setpoint S in the region C. The purged fuel vapor is increased to the upper limit HL in a control range W for the A/F control, and is reduced to the lower limit LL outside the control range W.

Since the purged fuel vapor is increased to the upper limit HL in the normal control region A, as described above, a sufficient amount of fuel vapor is purged from the charcoal canister 3 into the carburetor without adversely affecting the operation of the engine. In addition, fuel vapor can be purged accurately in controlled quantities which meet various engine loads since the upper and lower purge limits HL, LL are varied dependent on the engine load condition.

Figure 7:
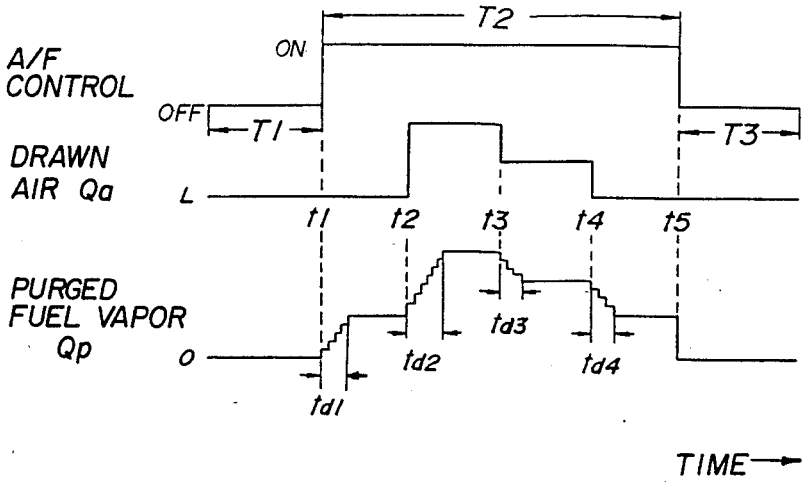
FIG. 7 is is a timing chart of operation of a controller according to still another embodiment of the present invention.

FIG. 7 is illustrative of a control operation according to still another embodiment of the present invention. The operation of FIG. 7 is substantially identical to that shown in FIG. 4 except that the controller 6 gradually increases and reduces the purged fuel vapor through PI (proportional plus integral) control, so that the purged fuel vapor will be increased and reduced to required levels after time intervals td1, td2, td3, td4.

According to a still further embodiment of the present invention, the air-fuel ratio control mode is forcibly returned to the central value of a control range either when the purged fuel vapor is cut off at the time the automobile is decelerated as by being braked or when the purged amount of fuel vapor is abruptly reduced.

Figure 9:
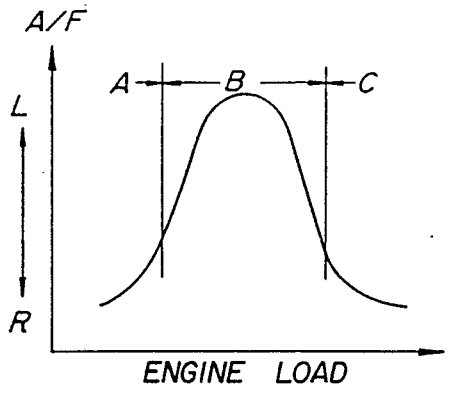
FIG. 9 is a graph illustrating varying air-fuel ratios plotted against engine loads.

Such air-fuel control will be described in detail below. The control effected by an air-fuel ratio control system is predetermined such that an optimum air-fuel ratio will always be given to an engine according to the engine load condition. More specifically, as shown in FIG. 9, when the engine is in a low load range A, the air-fuel ratio A/F is selected to be in a richer range R to operate the engine smoothly. In a medium engine load range B, the air-fuel ratio A/F is selected to be in a leaner range L since the pressure in the combustion chambers is high enough to allow stable combustion therein. When the engine is in a high load range C, the air-fuel ratio A/F is selected to be in the richer range R to meet higher engine output requirements and to increase supplied fuel to lower the combustion temperature through the cooling of the fuel for thereby protecting the engine.

Figure 10:
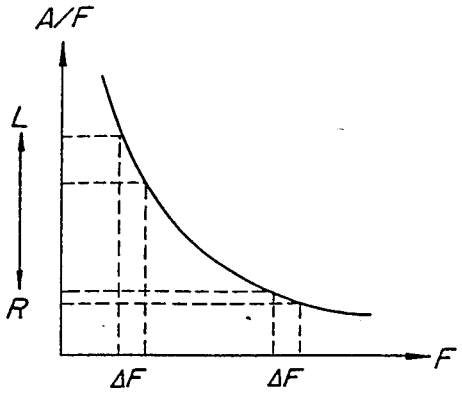
FIG. 10 is a graph showing varying air-fuel ratios plotted against supplied fuel.

The air-fuel ratio A/F varies with supplied fuel in a pattern shown in FIG. 10. Specifically, while the air-fuel ratio A/F is in the richer range R, a change $\Delta F$ in the supplied fuel F causes only a small change in the air-fuel ratio A/F. However, while the air-fuel ratio A/F is in the lesser range L, the change $\Delta F$ in the fuel supply F results in a larger change in the air-fuel ratio A/F.

When the engine undergoes a high load with the air-fuel ratio A/F being in the richer side, even a large amount of purged fuel vapor causes only a small change in the air-fuel ratio A/F, and does not adversely affect the engine operation. If, therefore, the engine load detected through the engine condition detector 24 (FIG. 2) by the controller 6 is in the high load range C, then the controller 6 increases the I (integral) component of the PI control mode to increase or reduce the purged fuel vapor quickly for effectively purging fuel vapor from the charcoal canister 3. If the engine load is very high, then the controller 6 fully opens the solenoid-operated valve 7 to maximize the amount of fuel vapor purged from the charcoal canister 3 since effects of the maximum amount of purged fuel vapor on the air-fuel ratio A/F are negligible.

When the detected engine load is in the medium load range B, the I component of the PI control mode is reduced to increase or reduce the purged fuel vapor gradually, so that the air-fuel ratio A/F for the engine will not be disturbed largely.

However, when the detected engine load is in the low load range A, purged fuel vapor affects the air-fuel ratio A/F to a large extent. Thus, the controller 6 fully closes the solenoid-operated valve 7 to cut off fuel vapor purged from the charcoal canister 3. If, at this time, fuel vapor is purged from the charcoal canister 3 during a air-fuel ratio control period and the air-fuel ratio control is effected on a richer side in the control range, then the air-fuel ratio A/F is corrected. However, it would be time-consuming if the air-fuel ratio A/F were corrected in the normal PI control mode.

When the engine load is abruptly lowered by braking the automobile, for example, the venturi vacuum PV is lowered and so is the amount of fuel vapor purged from the charcoal canister 3, with the result that the air-fuel ratio A/F is also abruptly lowered. If, at this time, the air-fuel ratio control is effected on the end of a richer or leaner side in the control range, it would take a long period of time to correct the air-fuel ratio A/F in the PI control mode, resulting in a long response delay.

These response delays which would be experienced either when purged fuel vapor is cut off by the controller 6 during air-fuel ratio control or when an abrupt reduction in the amount of purged fuel vapor is detected by the controller 6 during air-fuel ratio control, can be reduced by forcibly bringing the air-fuel ratio control mode to the central value of the air-fuel ratio control range. Thus, the time required to control the actual air-fuel ratio A/F so as to reach a desired air-fuel ratio setpoint in the subsequent air-fuel ratio control can effectively be shortened.

Figure 8A:
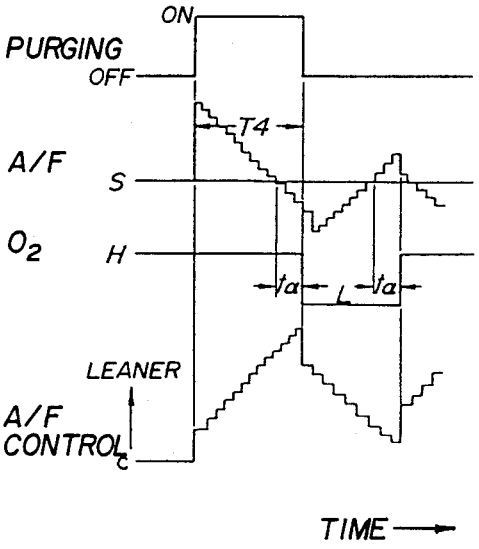
FIG. 8A is a timing chart showing a conventional mode of controlling an air-fuel ratio as fuel vapor is purged and shut off.
Figure 8B:
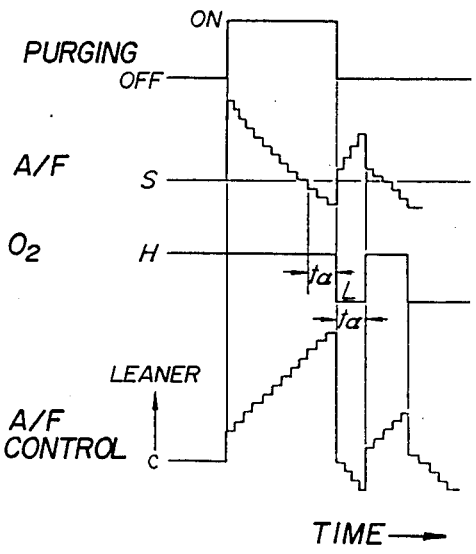
FIG. 8B is a timing chart showing a mode, according to a still further embodiment of the present invention, of controlling an air-fuel ratio as fuel vapor is purged and cut off.

FIG. 8A shows a conventional mode of controlling the air-fuel ratio A/F when purged fuel is cut off during air-fuel ratio control. In this control mode, the air-fuel ratio control mode is not brought back to the central value c of the control range when purged fuel vapor is cut off. As shown in FIG. 8A, at the time purged fuel vapor is cut off, the actual air-fuel ratio A/F deviates widely from the air-fuel ratio setpoint S due to the response delay $t\alpha$ of the air-fuel ratio control loop. Such a wide deviation results in a long period of time required before the actual air-fuel ratio A/F settles into its setpoint S under the air-fuel ratio control based on the output signal $O_2$ from the $O_2$ sensor. FIG. 8B illustrates an air-fuel ratio control mode according to the present invention. In the control mode of the invention, when purged fuel vapor is cut off, the air-fuel ratio control mode is brought back to the central value c of the control range, and hence the time required for the actual air-fuel ratio A/F to reach the setpoint S is shortened. Therefore, the air-fuel ratio control mode according to the present invention is of good response. The principles of the present invention, as described with reference to FIGS. 8A, 8B, 9 and 10, are applicable to an air-fuel ratio control system having no response delay.

The controller 6 may be in the form of a microprocessor, for example, which may be programmed to perform the various functions of the controller 6, as described above. Such a programming procedure is well within the knowledge of one of ordinary skill in the art.

Figure 11:
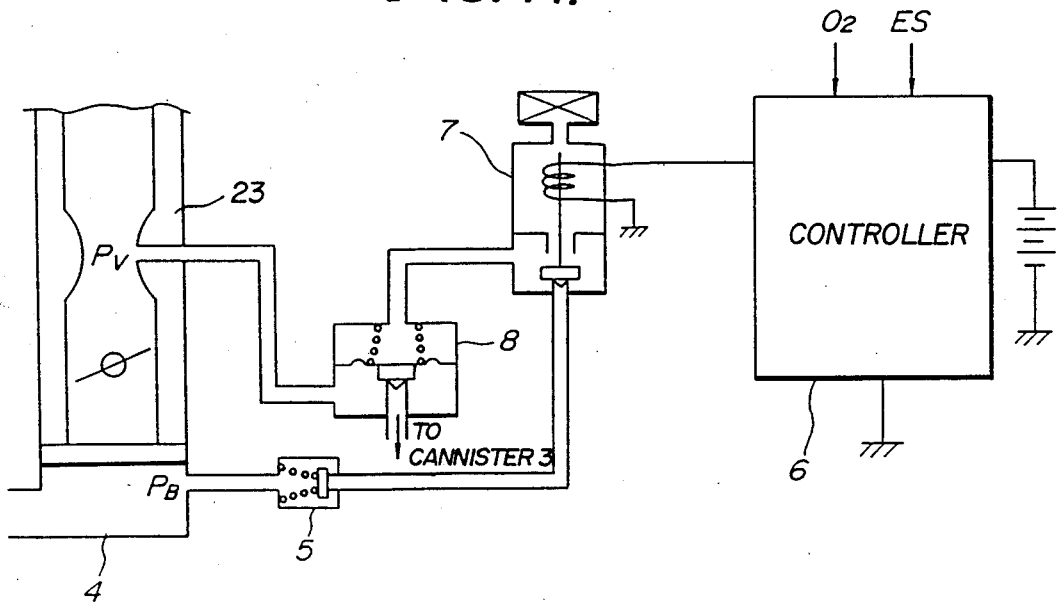
FIG. 11 is a schematic view of a specific fuel-vapor recovery arrangement for the system shown in FIG. 1.

FIG. 11 shows an alternative specific arrangement for the system illustrated in FIG. 1. The solenoid-operated valve 7 controlled by the controller 6 is coupled via a check valve 5 to an intake manifold 4 connected to the carburetor 23. The solenoid-operated valve 7 is also coupled to the carburetor 23 through a flow control valve 8 which is connected to the on-board charcoal canister 3. When the engine is operated, the check valve 5 is opened by a vacuum PB developed in the intake manifold 4. The vacuum PB from the intake manifold 4, as controlled by the solenoid-operated valve 7, acts on the flow control valve 8 to adjust the opening thereof. Stored fuel vapor is thus purged from the charcoal canister 3 under a venturi vacuum PV through the flow control valve 8, the opening of which is variable as a function of the intake manifold vacuum PB as controlled by the solenoid-operated valve 7.

Fuel vapor developed in the fuel tank 1 (FIG. 1) is delivered to and stored in another smaller-capacity charcoal canister (not shown), and stored fuel vapor is purged to the engine during operation thereof.

Although certain preferred embodiments have been shown and described, it should be understood that many changes and modifications may be made therein without departing from the scope of the appended claims.

We claim:

1. A system for controlling the amount of fuel vapor to be purged under an engine vacuum into a carburetor of an automotive engine from a charcoal canister and for controlling the air-fuel ratio of an air-fuel mixture to be supplied by the carburetor, said system comprising:
   - first means for controlling the air-fuel ratio;
   - second means for applying the engine vacuum to said charcoal canister to cause fuel vapor to be purged therefrom only when the air-fuel ratio is controlled by said first means; and
   - third means for regulating said applied engine vacuum to control the amount of purged fuel vapor to change in proportion to the amount of air drawn by the engine; and
   - fourth means for delaying the changing of the amount of purged fuel vapor according to a response delay of said first means when fuel vapor starts to be purged from said charcoal canister and also when the amount of purged fuel vapor is varied in proportion to the amount of drawn air.

2. A system according to claim 1, wherein the changing of the amount of purged fuel vapor is delayed with a time constant.

3. A system according to claim 1, wherein the changing of the amount of purged fuel vapor is delayed in a PI control mode.

4. A system for controlling the amount of fuel vapor to be purged under an engine vacuum into a carburetor of an automotive engine from a charcoal canister and for controlling the air-fuel ratio of an air-fuel mixture to be supplied by the carburetor, said system comprising:
   - first means for controlling the air-fuel ratio, including means for forcibly bringing the controlling of the air-fuel ratio to a central value of an air-fuel ratio control range when either purged fuel vapor is cut off or the amount of purged fuel vapor is abruptly reduced,
   - second means for applying the engine vacuum to said charcoal canister to cause fuel vapor to be purged therefrom only when the air-fuel ratio is controlled by said first means; and
   - third means for regulating said applied engine vacuum to control the amount of purged fuel vapor to change in proportion to the amount of air drawn by the engine.

5. A system for controlling the amount of fuel vapor to be purged under an engine vacuum into a carburetor of an automotive engine from a charcoal canister and for controlling the air-fuel ratio of an air-fuel mixture to be supplied to the carburetor, said system comprising:
   - first means for controlling the air-fuel ratio;
   - second means for applying the engine vacuum to said charcoal canister to cause fuel vapor to be purged therefrom only when the fuel-fuel ratio is controlled by said first means; and
   - third means for regulating said engine vacuum to establish upper and lower limits for the amount of purged fuel vapor, and for increasing the amount of purged fuel vapor to said upper limit when the air-fuel ratio is in a normal air-fuel ratio control region in which said air-fuel ratio deviates relatively slightly from an air-fuel ratio setpoint and for reducing the amount of purged fuel vapor to said lower limit when the air-fuel ratio is outside said normal air-fuel ratio control region.

6. A system according to claim 5, wherein said upper and lower limits are varied according to a load to which the engine is subjected.

* * * * *